US008506073B2

(12) United States Patent
Liang

(10) Patent No.: US 8,506,073 B2
(45) **Date of Patent: *Aug. 13, 2013**

(54) IMAGE TRANSFER SHEET WITH INKJET PRINTED IMAGE AND METHODS OF MAKING AND USING

(75) Inventor: Kangning Liang, Bartlett, TN (US)

(73) Assignee: Brother International Corporation, Bridgewater, NJ (US)

( * ) Notice: Subject to any disclaimer, the term of this patent is extended or adjusted under 35 U.S.C. 154(b) by 160 days.

This patent is subject to a terminal disclaimer.

(21) Appl. No.: 13/041,295

(22) Filed: Mar. 4, 2011

(65) Prior Publication Data

US 2012/0224013 A1 Sep. 6, 2012

(51) Int. Cl.
*B41J 2/01* (2006.01)

(52) U.S. Cl.
USPC ..... 347/105; 428/354; 156/230

(58) Field of Classification Search
USPC ..... 347/105; 428/354, 195.1, 32.39, 428/32.5, 98, 343; 156/230
IPC ..... B41J 2/01
See application file for complete search history.

(56) References Cited

U.S. PATENT DOCUMENTS

| | | | | |
|---|---|---|---|---|
| 6,309,734 | B1 * | 10/2001 | Taniguchi et al. | 428/195.1 |
| 6,761,969 | B2 * | 7/2004 | Li et al. | 428/354 |
| 2002/0029843 | A1 * | 3/2002 | Popat et al. | 156/240 |
| 2008/0233324 | A1 * | 9/2008 | Lee et al. | 428/40.1 |
| 2012/0222804 | A1 * | 9/2012 | Liang | 156/230 |

* cited by examiner

*Primary Examiner* — Manish S Shah
*Assistant Examiner* — Roger W Pisha, II
(74) *Attorney, Agent, or Firm* — Frommer Lawrence & Haug LLP

(57) ABSTRACT

A multilayer image transfer sheet for non-thermally transferring an image to a receiving object includes, in the following order with respect to each other, a backing sheet; a water-releasable sacrificial layer disposed on the backing sheet; an ink-absorbing layer disposed over the water-releasable sacrificial layer; a printed image layer formed on the ink-absorbing layer; and an adhesive layer disposed over the printed image layer and configured and arranged for permanent attachment of the printed image layer to a receiving object. The printed image layer includes ink printed to form at least one image.

22 Claims, 5 Drawing Sheets

IMAGE TRANSFER SHEET WITH INKJET PRINTED IMAGE AND METHODS OF MAKING AND USING

FIELD

The invention is directed to an image transfer sheet and method of making and using the image transfer sheet. The invention is also directed to an image transfer sheet with one or more sacrificial layers and a printed (e.g., inkjet-printed) image and methods of making and using the image transfer sheet.

BACKGROUND

There are many ways to decorate objects such as garments, mugs, and the like with a graphical image. For example, an image can be either directly printed on a garment using a specialized inkjet printer or a screen printing technique, or by first printing the image on a thermoplastic film and subsequently attaching it to a garment through an iron-on process at substantially elevated temperatures. However, these methods have some of the drawbacks including expensive specialty printing equipment and materials, tedious processes unsuitable to hobbyists and general consumers, safety concerns with using hot irons, limited applications, and heavy preparations.

There is a need for an image transfer method that allows for creating an image on an object with one or more advantages such as low cost, high quality, high versatility, consumer-friendliness, convenience, or safety.

BRIEF SUMMARY

One embodiment is a multilayer image transfer sheet for non-thermally transferring an image to a receiving object. The image transfer sheet includes, in the following order with respect to each other, a backing sheet; a water-releasable sacrificial layer disposed on the backing sheet; an ink-absorbing layer disposed over the water-releasable sacrificial layer; a printed image layer formed on the ink-absorbing layer; and an adhesive layer disposed over the printed image layer and configured and arranged for permanent attachment of the printed image layer to a receiving object. The printed image layer includes ink printed to form at least one image.

Another embodiment is a method for non-thermal transfer of an image onto an article. The method includes providing the multilayer image transfer sheet described above; permanently attaching the multilayer image transfer sheet to the article using the adhesive layer; removing the backing sheet; and removing the water-releasable sacrificial layer by exposure to water.

Yet another embodiment is a method of making a multilayer image transfer sheet. The method includes forming a water-releasable sacrificial layer on a backing sheet; forming an ink-absorbing layer over the sacrificial layer; printing an image layer onto the ink-absorbing layer using an inkjet printer; and disposing an adhesive layer over the image layer. The adhesive layer is configured and arranged for permanent attachment of the printed image layer to a receiving object.

A further embodiment is a sheet for non-thermally transferring an image to a receiving object. The sheet includes, in the following order with respect to each other, a backing sheet; a water-releasable sacrificial layer disposed on the release liner; and an ink-absorbing layer configured and arranged to receive an image printed by an inkjet printer onto the ink-absorbing layer.

Another embodiment is a kit for non-thermally transferring an image to a receiving object. The kit includes the sheet described immediately above; and adhesive configured and arranged for application over an image printed on the ink-absorbing layer and for permanent attachment of the sheet and image to a receiving object.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

The invention is directed to an image transfer sheet and method of making and using the image transfer sheet. The invention is also directed to an image transfer sheet with one or more sacrificial layers and a printed (e.g., inkjet-printed) image and methods of making and using the image transfer sheet.

An image transfer sheet includes a sacrificial layer onto, or over, which an image can be printed. In at least some embodiments, the image can be printed using conventional inkjet printers found in offices and households. Although the present description is generally directed to printing an image on the image transfer sheet using an inkjet printer (including printers that utilize liquid or hot-melt inks or pigments), it will be recognized that other types of printers may also be used for forming the image on the image transfer sheet. The image thus formed on the image transfer sheet can be transferred to the surface of a receiving object with the help of an adhesive. This transfer of the image to the receiving object is preferably a non-thermal transfer process. The sacrificial layer is eventually removed with the help of an appropriate solvent, such as water, resulting in an image bonded to the object.

These other image transfer sheets may be particularly useful for images formed using laser printers, Light Emitting Diode (LED) printers, or dye-sublimation printers.

As used herein and unless otherwise indicated, the term "layer" can refer to a layer formed by a single coating or by multiple coatings of the same or different material. Moreover, the layers, other than the printed image layer, can be formed by any suitable coating or layering method including, but not limited to, spray coating, dip coating, bar coating, brush coating, spin coating, air knife coating, gravure coating, gap coating, roll coating, silk screen coating, extrusion coating, or any other suitable technique for forming the layer.

One component of the image transfer sheet is the sacrificial layer that can be relatively easily released from a backing sheet and can be removed (for example, solvated or released from the other layers) using a solvent, such as water, leaving the image intact on the receiving object. It may also function as the receiving medium for the image or as the supporting layer for other functional layers. Preferably, the materials used to construct the sacrificial layer are substantially soluble in a solvent that does not cause substantial dissolution or degradation of the image.

In the embodiments described below, similar layers are given the same reference number among the different embodiments. It will be understood that, unless indicated otherwise, a description regarding a particular layer in one embodiment is generally applicable to the like-numbered layers in other embodiments.

Figure 1A:
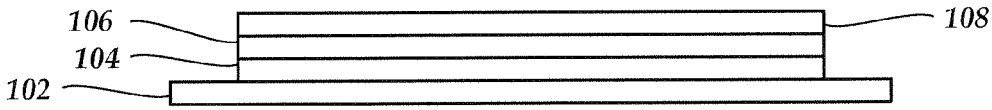
FIGS. 1A-1F illustrate steps in one embodiment of a process for the transfer of an image to a receiving object using an image transfer sheet, according to the invention.

FIGS. 1A-1F illustrate one embodiment of a method of transferring an image to a receiving object. FIG. 1A illustrates a backing sheet 102, a water-releasable sacrificial layer 104, an intermediate layer 106, and an ink-absorbing layer 108. Typically, the water-releasable sacrificial layer 104, intermediate layer 106, and ink-absorbing layer 108 are formed sequentially on the backing sheet 102.

The backing sheet 102 can be formed using any suitable polymer film or other substrate that can be separated from the sacrificial layer 104 relatively cleanly when desired. For example, the backing sheet can be made of polyethylene terephthalate (PET). Polymers (or combinations of polymers) other than PET can also be used as the backing sheet, such as polyesters, polyamides, polyacrylates, and polymethacrylates. The backing sheet should be compatible with the printing process (e.g., inkjet printing) used to print the image and be convenient to separate from the sacrificial layer 104. The thickness of the backing sheet 102 can be any suitable value such as, for example, in the range of 50 to 500 micrometers or in the range of 75 to 200 micrometers. It will be understood that the backing sheet may include any conventional film additives.

The sacrificial layer 104 is preferably water-releasable and, at least in some instances, water soluble. In some embodiments, the sacrificial layer may be releasable or soluble in another solvent in addition to, or as an alternative to, water. The choice of materials for the sacrificial layer can take into account several factors such as the material of the backing sheet, the method for printing the image, the solvent that is to be used to remove the sacrificial layer, film-forming properties, and safety. Any suitable polymer or combination of polymers can be used including, but not limited to, polyvinyl alcohol (PVA) or PVA crosslinked using glyoxal, borate, heat, or the like.

The sacrificial layer 104 may be formed using a single coating or multiple coatings of the same or different material onto the backing sheet 102. In the case where the sacrificial layer is composed of multiple coatings of polymers, the subsequent coatings should not disrupt the existing coatings.

The sacrificial layer 104 may serve as a temporary medium to receive the image-forming materials (for example, toners or inks) or the support for an inteiniediate, ink-absorbing, or functional layer as described herein. Accordingly, the sacrificial layer 104 is selected to endure the printing process to be used to form the image. After the image has been transferred to a desired surface, it can be conveniently separated from the backing sheet and then removed through solvent treatment without affecting the quality of the transferred image.

An optional intermediate layer 106 can be formed on the sacrificial layer 104. The intermediate layer 106 can be formed by a single coating or multiple coatings of the same or different material. Preferably, the intermediate layer 106 can be coated using a solvent that does not solvate the sacrificial layer 104. In some embodiments, the intermediate layer 106 is soluble or releasable using a same solvent (e.g., water) as the sacrificial layer 104 to permit removal of the intermediate layer 106 with the sacrificial layer 104 at a later stage of the transfer process.

Any suitable polymer (or combination of polymers) can be used including, but not limited to, polyvinylpyrrolidone (PVP), polyacrylamide, poly(ethylene oxide), and poly(2-ethyl-2-oxazoline).

One example of an embodiment uses a PET backing layer, a PVA sacrificial layer, and a PVP intermediate layer. Because PVA does not have strong adhesion to some plastics such as PET, which enables convenient separation between the two films, a thin film of PVA from a PVA solution can be deposited on PET to serve as the sacrificial layer for the image transfer sheet. In at least some embodiments, it is preferred that PVA has a hydrolyzed content ranging from 80% to 100%. The thickness of the PVA layer can be any suitable value including a thickness in the range from 5 micrometers to 500 micrometers or in the range from 10 micrometers to 100 micrometers.

A polymer such as PVP can be applied on the PVA layer as an intermediate layer. Both PVA and PVP polymers are soluble in water; however, their solubility in organic solvents is substantially different. After the PVA layer is dry, a solution of PVP in an organic solvent such as isopropanol, which is not a good solvent for PVA, can be applied onto the surface of the PVA layer using, for example, a film coater. Because PVA is not substantially soluble in isopropanol, PVP can form a uniform thin film on the PVA thin film without causing significant damage to the PVA layer underneath. The intermediate layer can have any suitable thickness including a thickness in the range from 5 micrometers to 500 micrometers or in the range from 10 to 50 micrometers.

An ink-absorbing layer 108 can be formed over the optional intermediate layer 106, or the sacrificial layer 104 if there is no intermediate layer. When an image is formed using an inkjet printer, the use of an ink-absorbing layer may improve the image quality. Because many inkjet printers use water-based inks, the materials for ink-absorbing layer are preferably hydrophilic and porous to absorb inks. Because some inks, especially dye-based inks, can be re-dissolved or re-dispersed into water, it is often useful to isolate the inkjet image from any water source, which can be accomplished by sandwiching the inkjet image between two functional layers, as described below.

Any material suitable for absorbing ink can be used including, but not limited to, highly hydrophilic polymers such as PVA, PVP, polyacrylamide, poly(ethylene oxide), poly(2-ethyl-2-oxazoline), poly(acrylic acid), polymethacrylate, polystyrenesulfonate, and their copolymers or block polymers; nanosized inorganic particles such as silica, alumina, calcium carbonate, barium sulfate, etc.; or a combination thereof. One example of an ink-absorbing layer formulation includes 1.564 g of 6.7% PVA (99+% hydrolyzed), 4.679 g of Snowtex-C (Nissan Chemicals), 0.0653 g of 10% Triton X-100, and 0.0168 g of 1.0% glyoxal (Aldrich). The thickness of the ink-absorbing layer can be any suitable value including, for example, thicknesses in the range from 5 micrometers to 100 micrometers or in the range from 10 micrometers to 30 micrometers.

Preferably, the ink-absorbing layer 108 is not removed with the sacrificial layer 104 and the intermediate layer 106, if present. In at least some embodiments, the ink-absorbing layer is not soluble in a solvent that is used to remove the sacrificial layer. In at least some embodiments, as described in more detail below, a functional layer may be disposed between the sacrificial layer and the ink-absorbing layer which protects the ink-absorbing layer from being removed with the sacrificial layer.

Figure 1B:
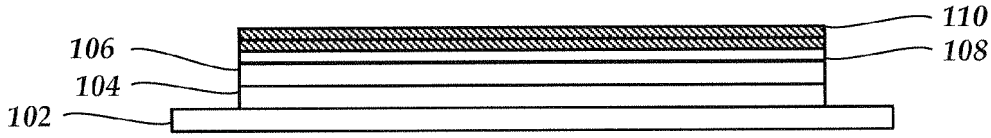

In FIG. 1B, a printed image layer 110 is formed on the ink-absorbing layer 108. The printed image layer 110 is formed by inkjet printing or any other suitable printing process. The printed image layer 110 includes ink (which may incorporate pigments, dyes, or the like) or any other suitable printing material. The ink or other printing material is typically absorbed at least partially into the ink-absorbing layer 108, as illustrated schematically in FIG. 1B. Although the printed image layer 110 in FIG. 1B appears continuous, it will be recognized that this is not necessary and that the printed image layer 110 may be discontinuous and may include gaps. Optionally, the printed image does not cover the entire area of a sheet containing the other layers and so the printed image can be cut out of the sheet before, or after, application of an adhesive layer (see below).

Figure 1C:
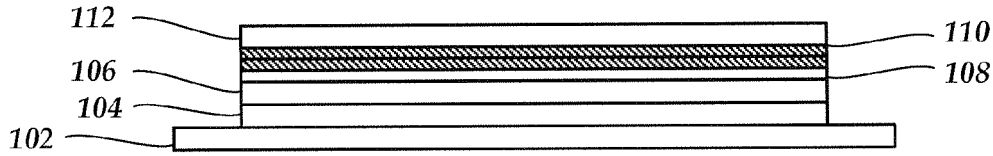

In FIG. 1C, an adhesive layer 112 is disposed over the printed image layer 110. The adhesive layer is for bonding the printed image layer to a receiving object. As a result, the choice of the adhesive is at least partially dependent on the nature of the receiving object and how the receiving object is to be used. For instance, water soluble adhesive should not be chosen if the image is transferred to a garment, which often undergoes many washing and drying operations during its use. Spray adhesive, liquid adhesive, or any other suitable adhesive formulation can be used. Optionally, a second backing sheet (not shown) can be placed over the adhesive layer, particularly, if the image is to be transferred to a receiving object much later.

The adhesive can be reactive or non-reactive. For applications that do not involve bending or movement of the image, a cross-linkable adhesive (epoxy adhesives, reactive polyurethanes, and the like) may be preferred, especially when the image is to be transferred to a hard surface such as, for example, a ceramic mug.

The adhesive layer preferably completely covers the whole surface of the printed image layer. The adhesive layer can have any suitable thickness including a thickness in the range of 5 micrometers to 200 micrometers or in the range from 10 to 50 micrometers.

Figure 1D:
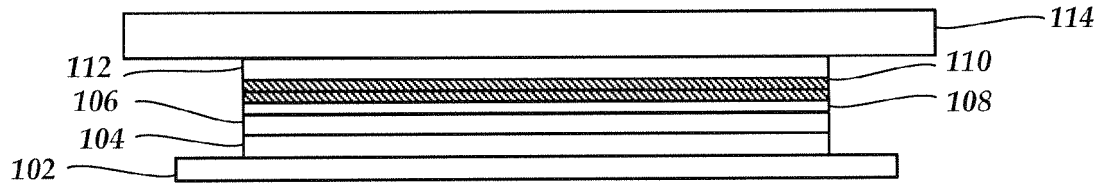

The image transfer sheet is attached to a receiving object 114, as illustrated in FIG. 1D. If a second backing sheet was applied over the adhesive layer 112, then the second backing sheet is removed prior to attachment to the receiving object 114. Any suitable receiving object can be used including receiving objects made from cloth, fabric, leather, plastic, ceramic, metal, wood, paper, fingernail, and the like. The adhesive layer 112 binds the image transfer sheet to the receiving object 114. Preferably, the adhesive layer 112 permanently binds the printed image layer 110 directly or indirectly to the receiving object 114.

The attachment of the image transfer sheet to the receiving object is preferably performed non-thermally (e.g., without the application of substantial heat for the transfer). It will be understood that such non-thermal transfer may include application of some heat after the attachment to dry the adhesive, but such heating is not generally required.

Figure 1E:
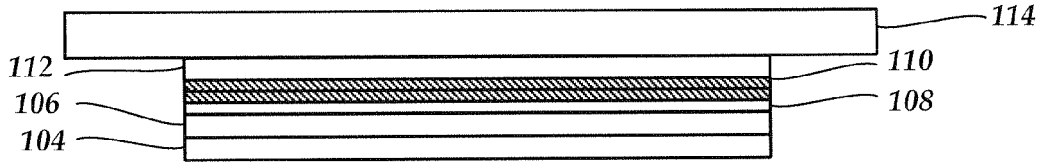
Figure 1F:
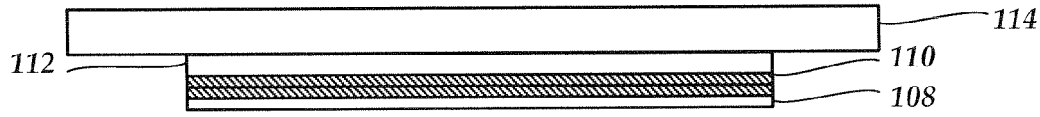

After sufficient bonding strength between the adhesive layer 112 and the receiving object has been achieved, the backing sheet 102 can be removed by carefully peeling it away from the sacrificial layer, as illustrated in FIG. 1E. The sacrificial layer 104 and, optionally, the intermediate layer 106 can then be removed as illustrated in FIG. 1F. The removal of the sacrificial layer 104 can be accomplished by rinsing the sacrificial layer with water or another applicable solvent. The rinsing time may depend on the sacrificial layer and the solvent and can be, for example, for a period ranging from 30 seconds to 1 minute or simply immersing it into water for up to 1 minute. If rinsing the image with water or other solvent is not permitted, the image can be wiped with a wet towel to remove the sacrificial layer. In at least some instances, the intermediate layer 106 is also removed using water or other solvent.

Figure 2A:
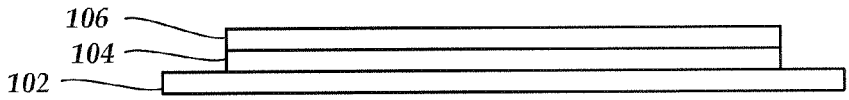
FIGS. 2A-2E illustrate steps in a second embodiment of a process for the transfer of an image to a receiving object using an image transfer sheet, according to the invention.
Figure 2B:
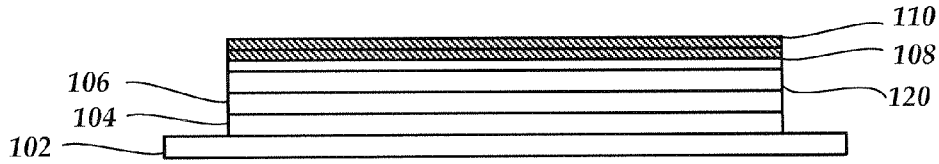

FIGS. 2A-2E illustrate another embodiment of a method of transferring an image to a receiving object. FIG. 2A illustrates a backing sheet 102, a water-releasable sacrificial layer 104, and an intermediate layer 106. In FIG. 2B, a functional layer 120 is formed on the intermediate layer 106, an ink-absorbing layer 108 is formed on the functional layer 120, and then a printed image layer 110 is formed on the ink-absorbing layer 108.

The functional layer 120 can be, for example, a protection layer to further enhance the quality of the final product. For example, the functional layer 120 can be a protection layer that covers the toner or ink of the image and not only protects the image from toner or ink loss and quality degradation, but also offers additional physical properties to improve or enhance the look and feel of the image. For example, a protection layer may be water resistant to protect the underlying image from water. This may be particularly useful for images transferred to garments which will be subjected periodically to washing.

The functional layer may include one or multiple coatings of polymers, depending on the application. It will be also understood that a transfer sheet can include more than one functional layer, particularly if each layer has a different function (e.g., a protection layer and a flexible layer).

Additionally or alternatively, the functional layer 120 can give the image certain physical attributes such as flexibility, glossy finish, matte finish, and so forth. Film-forming products such as spray finishes and lacquers, polymers such as polymethylmethacrylate (PMMA), polystyrene (PS), polyurethanes (PU), polyesters (PE), and their copolymers or block polymers can be used to form the functional layer, depending on the applications of the end products and the materials of the other layers. The functional layer can have any suitable thickness including a thickness in the range from 5 micrometers to 1000 micrometers or in the range between 10 to 100 micrometers.

In some embodiments, a flexible functional layer is used. This may be particularly useful when the image is to be transferred onto a garment that will be stretched, folded, and so forth. Materials for a flexible functional layer can include, for example, a polymer such as polymethylmethacrylate (PMMA) containing a plasticizer or a proper copolymer or block polymer may be selected. When a plasticizer is used, its amount can range from, for example, 1% to 50% by weight in solid film state, preferably from 10% to 30% by weight. For PMMA, dibutyl phthalate (DBP) and dioctyl terephthalate (DOTP) are examples of suitable plasticizers. Alternatively or additionally, polymers having long hydrocarbon siding chains such as poly(butyl methacrylate) or poly(hexyl methacrylate) can also be used to form a flexible functional layer. Also particularly useful are block polymers that have alternate rigid segments and flexible segments polymer backbone, such as polystyrene-block-polybutadiene-block-polystyrene, polystyrene-block-polyisopreneblock-polystyrene, and polystyrene-block-poly(ethylene-ran-butylene)-block-polystyrene. The content of polystyrene in these block polymers can range from, for example, 5% to 50% or from 10% to 30%. In at least some embodiments, these block polymers can be dissolved into an organic solvent such as toluene and coated onto the sacrificial layer or the intermediate layer. Since these block polymers are often tacky and easy to melt, an optional separation layer of plasticized PMMA may be desirable over the flexible functional layer so that the transfer sheet does not stick to any printer elements during the printing process, preventing jamming or damage to the printer. The separation layer can have any suitable thickness, for example, a thickness ranging from 5 micrometers to 500 micrometers or from 10 micrometers to 50 micrometers.

Additionally or alternatively, the functional layer 120 can protect the image from ultraviolet (UV) light, which can cause degradation of the image. In this case, UV-absorbing inorganic compounds (for example, nano-sized titanium dioxide or zinc oxide) or UV-absorbing organic compounds (for example, benzophenones) can be incorporated into the protection layer through dissolution or dispersion of these UV-absorbing compounds in a suitable medium for coating. This UV protection layer can effectively absorb UV light while maintaining visibly colorless and clear.

Figure 2C:
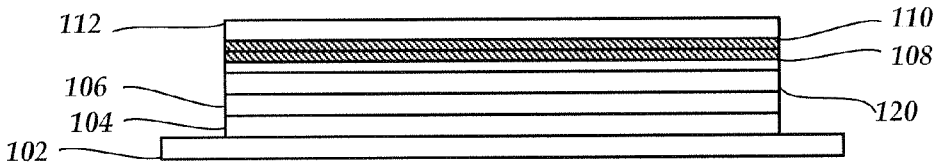
Figure 2D:
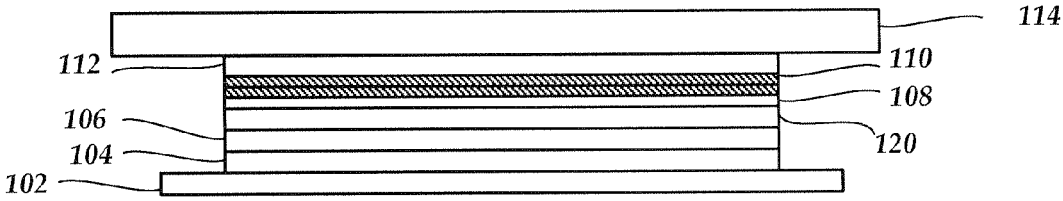
Figure 2E:
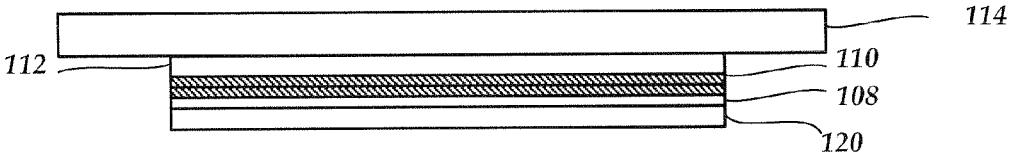
Figure 3A:
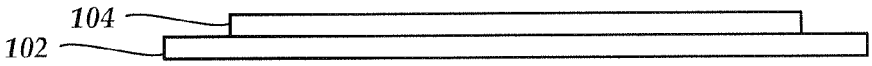
FIGS. 3A-3E illustrate steps in a third embodiment of a process for the transfer of an image to a receiving object using an image transfer sheet, according to the invention.
Figure 3B:
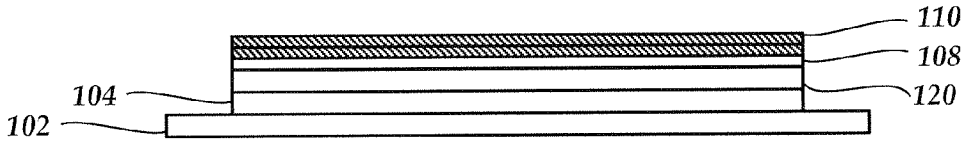
Figure 3C:
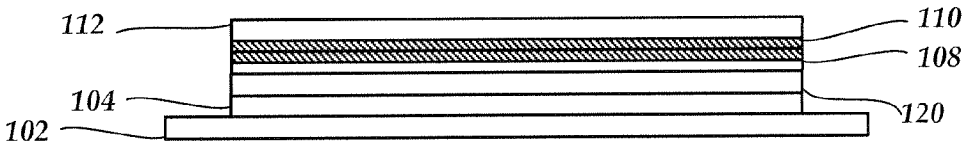
Figure 3D:
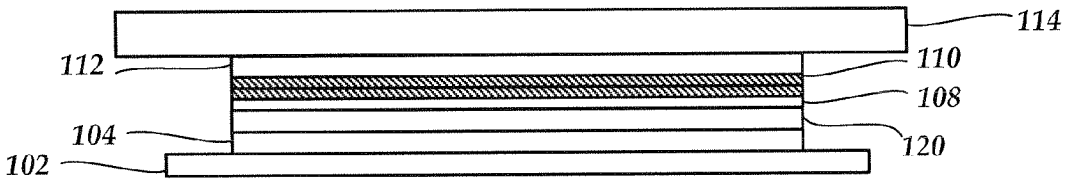
Figure 3E:
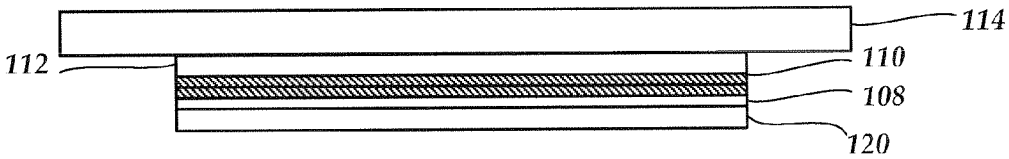

The ink-absorbing layer 108 and printed image layer 110 are formed over the functional layer 120. An adhesive layer 112 is formed over the printed image layer 110, as illustrated in FIG. 2C, and the image transfer sheet is then applied to a receiving object 114, as illustrated in FIG. 2D. The backing sheet 102, water-releasable layer 104, and optional intermediate layer 106 can be removed, as illustrated in FIG. 2E.

FIGS. 3A-3E illustrate another embodiment, similar to the embodiment of FIGS. 2A-2E, except that there is no intermediate layer. Instead, the functional layer 120 (or functional layers) is formed directly on the sacrificial layer 104.

Figure 4A:
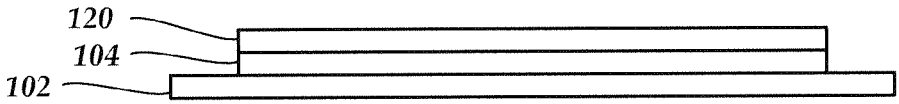
FIGS. 4A-4E illustrate steps in a fourth embodiment of a process for the transfer of an image to a receiving object using an image transfer sheet, according to the invention.
Figure 4B:
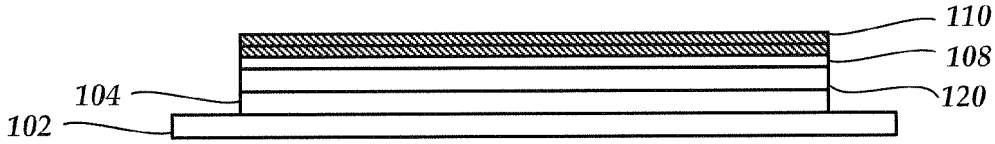
Figure 4C:
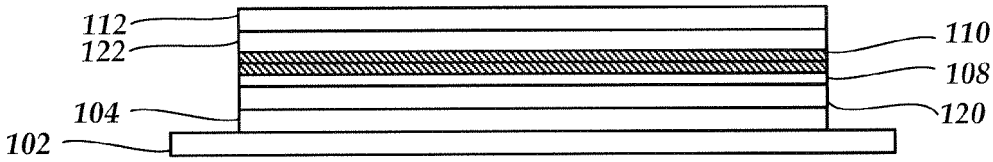
Figure 4D:
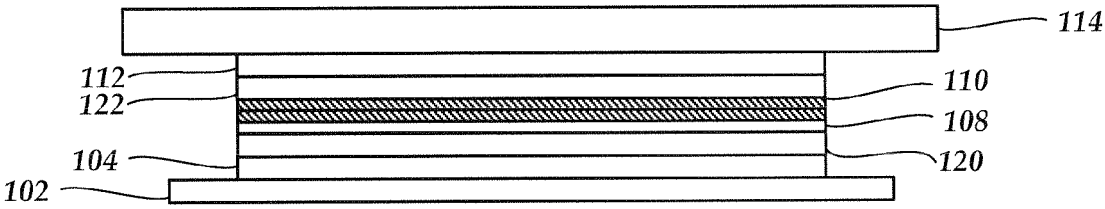
Figure 4E:
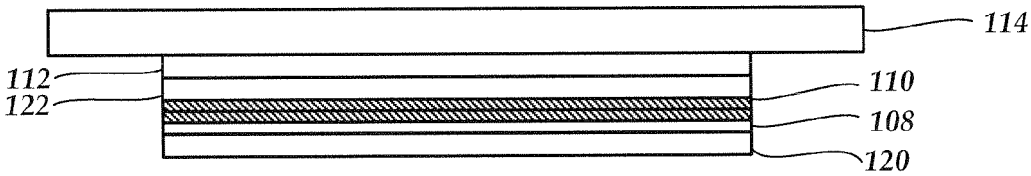

FIGS. 4A-4E illustrate a further embodiment in which a second functional layer 122 is formed over the printed image layer 110, as illustrated in FIG. 4C. The adhesive layer 112 is disposed over the second functional layer 122. The second functional layer 122 may be any of the layers described above with respect to functional layer 120. For example, the second functional layer 122 may be a protection layer that protects the printed image layer 110. The second functional layer 122 may be water-resistant to protect the printed image layer 110 from water (for example, if the receiving object 114 is a garment that will be washed repeatedly which may damage the printed image layer). The second functional layer 122 may be a flexible layer to provide flexibility for the transferred image (for example, for a garment that will be folded creased, stretched, and the like.)

It will be understood that variations on this embodiment can be made. For example, a particular embodiment may omit the functional layer 120, the intermediate layer 106, or both.

Figure 5A:
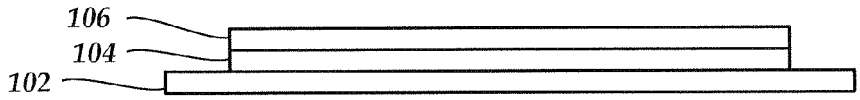
FIGS. 5A-5E illustrate steps in a fifth embodiment of a process for the transfer of an image to a receiving object using an image transfer sheet, according to the invention.
Figure 5B:
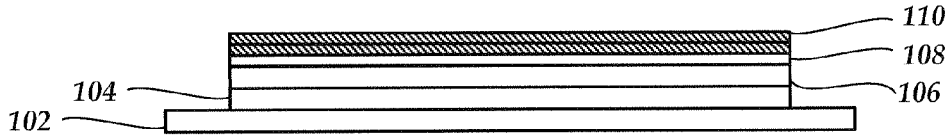

FIGS. 5A-5E illustrate another embodiment of a method of transferring an image to a receiving object. FIG. 5A illustrates a backing sheet 102, a water-releasable sacrificial layer 104, and an intermediate layer 106. In FIG. 5B, an ink-absorbing layer 108 is formed on the intermediate layer 106 and a printed image layer 110 is formed on and within the ink-absorbing layer 108.

Figure 5C:
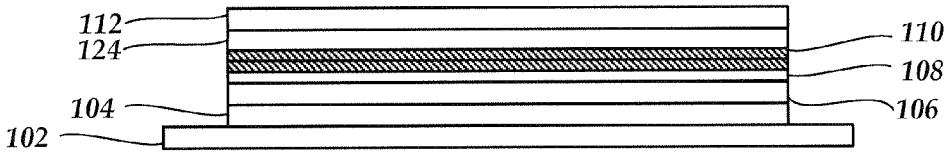

In FIG. 5C, a background color layer 124 is formed over the printed image layer 110. The background color layer 124 provides color in the gaps and discontinuities of the printed image layer 110. The background color layer can be any color. White is a particularly useful color, especially if the receiving object is not white. For example, if the receiving object is black or a non-white color, a white background layer is used to shield the image from the colors of the object. A white background layer can be formed using, for example, white spray paints, oil-based white paints, or water-based white paints. The thickness of the white background layer may be such that the underneath image cannot be seen through the white background layer. The background color layer can be any suitable thickness including, for example, a thickness in the range of 5 micrometers to 500 micrometers or in the range of 10 to 30 micrometers.

Figure 5D:
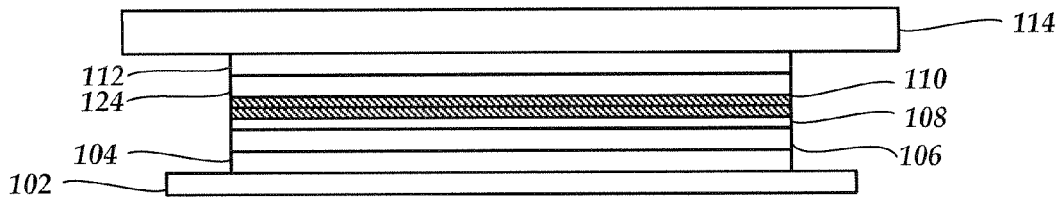
Figure 5E:
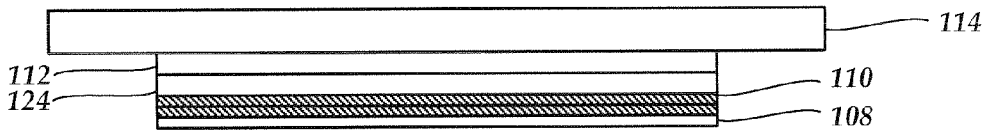

An adhesive layer 112 is formed over the background color layer, as illustrated in FIG. 5C, and the image transfer sheet is then applied to a receiving object 114, as illustrated in FIG. 5D. The backing sheet 102, sacrificial layer 104, and optional intermediate layer 106 are removed as illustrated in FIG. 5E.

It will be understood that variations on this embodiment can be made. For example, another embodiment may add a functional layer between the sacrificial layer and the printed image layer or a second functional layer between the background color layer and the adhesive layer or both functional layers. Some embodiments may omit the intermediate layer.

As an alternative to, or in addition to, providing a functional layer that produces a matte finish, the sacrificial layer 104, intermediate layer 106, or functional layer 120 (or any combination of these layers) may be roughened so that subsequently formed layers (and, in particular, the subsequently formed printed image layer) have a roughened surface resulting in a matte finish to the printed image layer. For example, the sacrificial layer 104, intermediate layer 106, or functional layer 120 might be treated with a substance (e.g., an acid or a liquid that partially solvates, pits, or otherwise roughens the layer) which removes portions of the layer in a non-uniform manner. As another example, if the functional layer is PMMA, an organic solvent, such as methyl ethyl ketone, ethyl acetate, or acetone, can be carefully sprayed over the coating to form "micro-craters" on the surface of PMMA. If no function layer 120 and intermediate layer 106 is used, a glycol ether, such as diethylene glycol ethyl ether, can be sprayed onto the sacrificial layer 104 to roughen the surface of that layer.

Although the individual components for making the coatings might be provided to a consumer in a kit, the image transfer sheet could be provided to the consumer in a complete (e.g., containing all of the layers and ready to attach to the receiving object) or a partial form. In the complete form, the printed image layer 110 already includes the image to be transferred. Optionally, this image transfer sheet includes a second backing sheet over the adhesive layer 110. The second backing sheet can then be removed and the image transfer sheet applied to the receiving object 114.

A variety of partial forms can also be provided. For example, a partial image transfer sheet may be provided that includes the backing sheet 102, sacrificial layer 104, and ink-absorbing layer 108 (and optionally one or both of the optional intermediate layer 106 and the optional functional layer 120). This sheet is then ready for the consumer to form the printed image layer 110 and then apply the adhesive layer 112 (and optionally a second functional layer). The consumer selects a desired image and then places the partial image transfer sheet into a printer (e.g., an inkjet printer) to form the printed image layer 110 on the partial image transfer sheet. The consumer can then apply the adhesive and transfer the image to the receiving object as described above. In some embodiments, the consumer may also form one or more functional layers 122 after printing the image.

Another partial form includes the printed image layer already formed and only requires the addition of an adhesive layer. The consumer forms the adhesive layer and then transfers the image to the receiving object as described above. It will be recognized that other partial image transfer sheets can be provided. It will also be recognized that a partial image transfer sheet can be included in a kit with one or more items such as adhesive, paper, film (e.g., a backing sheet), toner, ink, or even a printer.

In some embodiments, the backing sheet 102, sacrificial layer 104, optional intermediate layer 106, and optional functional layer 120 may be attached to a paper or film to facilitate printing of the printed image layer 110 using a printer. The paper or film can act as a carrier to carry the layers through the printer and the paper or film can be later removed prior to or after transferring the image to the receiving object.

EXAMPLES

Example 1

Transfer of an Inkjet-Printed Image to White Weave

A 6.7% polyvinyl alcohol (PVA) (99+% hydrolyzed, purchased from Aldrich) solution was coated on a piece of a white poly(ethylene terephthalate) (PET) sheet using an Elcometer 4340 Motorized Automatic Film Applicator (Elcometer Inc., Rochester Hills, MI.). The coating parameters were 200 micrometers in height setting and 20 in speed setting. After drying under ambient condition for about 60 minutes a clear and smooth PVA thin coating was obtained.

A functional layer was formed on the PVA layer by spraying on one pass Krylon Low Odor Clear Finish (Gloss) (Krylon Products Group, Cleveland, Ohio) to cover the area of the PVA-PVP layers. It was then dried under ambient conditions for 2 hours.

A mixture, composed of 1.5960 g of 6.7% PVA, 4.6321 g Snowtex-C (Nissan Chemical America Corporation, Houston, Tex.), 0.0152 g of 1% glyoxal (Sigma-Aldrich, Milwaukee, Wis.), and 0.0639 g of 10% Triton X-100 (Sigma-Aldrich, Milwaukee, Wis.) was coated on the functional layer using the Elcometer 4340 at height setting 200 micrometers and speed setting of 20. It was dried under ambient conditions for 2 hours to yield a white coating.

An image was printed on the ink-absorbing layer using a Brother MFC-6490CW inkjet printer. In order to protect the inkjet image from solvents like water, another functional layer coating was formed on the surface of the image to sandwich the image between two protective layers. This protective layer is formed the same way as the previous one by spraying Krylon Crystal Clear Finish (Flat) (Krylon Products Group, Cleveland, Ohio) over the image and allowing it to dry for 2 hours under ambient conditions.

The image was cut out of the sheet before it was bonded to a white weave. After Elmer's Spray Adhesive (Elmer's Products Inc., Columbus, Ohio) was applied over the image cutout on the side of the protective coating, it was promptly attached to a piece of white weave (JoAnn Fabrics) and the adhesive was allowed to set under ambient conditions for 3 hours.

After the PET backing sheet was carefully peeled away from the PVA layer, the image was immersed into water to dissolve the PVA layer. The resultant article was obtained after drying under ambient conditions.

Example 2

Transfer of an Inkjet-Printed Image to a Black Cotton Fabric

A 6.7% polyvinyl alcohol (PVA) (99+% hydrolyzed, purchased from Aldrich) solution is coated on a piece of a white poly(ethylene terephthalate) (PET) sheet using an Elcometer 4340 Motorized Automatic Film Applicator (Elcometer Inc., Rochester Hills, MI.). The coating parameters are 200 micrometers in height setting and 20 in speed setting. After drying under ambient conditions a clear and smooth PVA thin coating is obtained.

A functional layer is formed on the PVA layer by spraying on one pass Krylon Low Odor Clear Finish (Gloss) (Krylon Products Group, Cleveland, Ohio) to cover the area of the PVA-PVP layers. It is then dried under ambient conditions.

A mixture, composed of 1.5960 g of 6.7% PVA, 4.6321 g Snowtex-C (Nissan Chemical America Corporation, Houston, Tex.), 0.0152 g of 1% glyoxal (Sigma-Aldrich, Milwaukee, Wis.), and 0.0639 g of 10% Triton X-100 (Sigma-Aldrich, Milwaukee, Wis.) is coated on the functional layer using the Elcometer 4340 at height setting 200 micrometers and speed setting of 20. It is dried under ambient conditions.

An image is printed on the ink-absorbing layer using an inkjet printer. It is then sprayed with white paint to produce a white background layer. The white paint is dried under ambient conditions. In order to protect the inkjet image from solvents like water, another functional layer coating is formed on the surface of the white paint to sandwich the image between two protective layers. This protective layer is formed the same way as the previous one by spraying Krylon Crystal Clear Finish (Flat) (Krylon Products Group, Cleveland, Ohio) over the image and allowing it to dry under ambient conditions.

The image is cut out of the sheet before it is bonded to a black cotton fabric. After Elmer's Spray Adhesive (Elmer's Products Inc., Columbus, Ohio) is applied over the image cutout on the side of the protective coating, it is promptly attached to the fabric and the adhesive is allowed to set under ambient conditions.

After the PET backing sheet is carefully peeled away from the PVA layer, the image is immersed into water to dissolve the PVA layer. The resultant article is obtained after drying under ambient conditions.

Example 3

Transfer of an Inkjet-Printed Image to the Outer Wall of a Ceramic Mug

A 6.7% polyvinyl alcohol (PVA) (99+% hydrolyzed, purchased from Aldrich) solution is coated on a piece of a white poly(ethylene terephthalate) (PET) sheet using an Elcometer 4340 Motorized Automatic Film Applicator (Elcometer Rochester Hills, MI.). The coating parameters are 200 micrometers in height setting and 20 in speed setting. After drying under ambient condition a clear and smooth PVA thin coating is obtained.

A functional layer is formed on the PVA layer by spraying on one pass Krylon Low Odor Clear Finish (Gloss) (Krylon Products Group, Cleveland, Ohio) to cover the area of the PVA-PVP layers. It is then dried under ambient conditions.

A mixture, composed of 1.5960 g of 6.7% PVA, 4.6321 g Snowtex-C (Nissan Chemical America Corporation, Houston, Tex.), 0.0152 g of 1% glyoxal (Sigma-Aldrich, Milwaukee, Wis.), and 0.0639 g of 10% Triton X-100 (Sigma-Aldrich, Milwaukee, Wis.) is coated on the functional layer using the Elcometer 4340 at height setting 200 micrometers and speed setting of 20. It is dried under ambient conditions.

An image is printed on the ink-absorbing layer using an inkjet printer. The image is cut out of the sheet using a pair of scissors. After spraying with Elmer's Spray Adhesive over the image cutout, it is allowed to dry under ambient conditions before it is attached to the outer wall of a ceramic mug. The PET sheet is carefully peeled off from the sacrificial coating and the mug is further dried under ambient conditions. The PVA layer is removed by exposure to gentle running tap water for about 1 minute.

The above specification, examples and data provide a description of the manufacture and use of the composition of the invention. Since many embodiments of the invention can be made without departing from the spirit and scope of the invention, the invention also resides in the claims hereinafter appended.

What is claimed as new and desired to be protected by Letters Patent of the United States is:

1. A multilayer image transfer sheet comprising, in the following order with respect to each other:

a backing sheet;

a water-releasable sacrificial layer disposed on the backing sheet;

an ink-absorbing layer disposed over the water-releasable sacrificial layer;

a printed image layer formed on the ink-absorbing layer, wherein the printed image layer comprises ink printed to form at least one image; and an adhesive layer disposed over the printed image layer and configured and arranged for permanent attachment of the printed image layer to a receiving object, wherein the multilayer image transfer sheet is adapted to non-thermally transfer an image to the receiving object.

2. The image transfer sheet of claim 1, further comprising an intermediate layer disposed between the water-releasable sacrificial layer and the ink-absorbing layer.

3. The image transfer sheet of claim 2, wherein the intermediate layer is water-releasable.

4. The image transfer sheet of claim 1, wherein the adhesive layer is configured and arranged for non-thermal permanent attachment of the printed image layer to the receiving object.

5. The image transfer sheet of claim 1, further comprising a protective layer formed between the printed image layer and the adhesive layer, the protective layer being water-resistant.

6. The image transfer sheet of claim 1, further comprising a protective layer formed between the ink-absorbing layer and the water-releasable sacrificial layer, the protective layer being water-resistant.

7. The image transfer sheet of claim 1, further comprising a background color layer formed between the printed image layer and the adhesive layer.

8. The image transfer sheet of claim 1, wherein the water-releasable sacrificial layer comprises polyvinyl alcohol.

9. The image transfer sheet of claim 1, wherein the backing sheet comprises polyethylene terephthalate.

10. The image transfer sheet of claim 1, further comprising a second backing sheet disposed over the adhesive layer.

11. The image transfer sheet of claim 1, further comprising a flexible functional layer formed between the printed image layer and the water-releasable sacrificial layer.

12. The image transfer sheet of claim 1, wherein the printed image layer comprises ink printed by an inkjet printer to form the at least one image.

13. A method for non-thermal transfer of an image onto an article, the method comprising:

providing the multilayer image transfer sheet of claim 1;

permanently attaching the multilayer image transfer sheet to the article using the adhesive layer;

removing the backing sheet; and removing the water-releasable sacrificial layer by exposure to water, whereby the image of the multilayer image transfer sheet is non-thermally transferred to the article.

14. A method of making a multilayer image transfer sheet, the method comprising:

forming a water-releasable sacrificial layer on a backing sheet;

forming an ink-absorbing layer over the sacrificial layer;

printing an image layer onto the ink-absorbing layer using an inkjet printer; and disposing an adhesive layer over the image layer, wherein the adhesive layer is configured and arranged for non-thermal transfer and permanent attachment of the image layer to a receiving object.

15. The method of claim 14, further comprising forming an intermediate layer between the water-releasable sacrificial layer and the ink-absorbing layer.

16. The method of claim 14, further comprising forming a protective layer between the image layer and the adhesive layer, the protective layer being water-resistant.

17. The method of claim 14, further comprising forming a protective layer between the ink-absorbing layer and the water-releasable sacrificial layer, the protective layer being water-resistant.

18. A sheet for transferring an image to a receiving object, comprising, in the following order with respect to each other:

a backing sheet;

a water-releasable sacrificial layer disposed on the backing sheet; and an ink-absorbing layer configured and arranged to receive an image printed by an inkjet printer onto the ink-absorbing layer, wherein the sheet is adapted to non-thermally transfer the image to a receiving object.

19. The sheet of claim 18, wherein the image receiving layer comprises an intermediate layer disposed between the water-releasable sacrificial layer and the ink-absorbing layer.

20. The sheet of claim 18, wherein the image receiving layer comprises a protective layer disposed between the water-releasable sacrificial layer and the ink-absorbing layer.

21. The sheet of claim 20, further comprising a water-releasable intermediate layer disposed between the protective layer and the water-releasable sacrificial layer.

22. A kit for non-thermally transferring an image to a receiving object, comprising:

the sheet of claim 18; and adhesive configured and arranged for application over an image printed on the ink-absorbing layer and for permanent attachment of the sheet and image to a receiving object.

* * * * *